United States Patent [19]

Suga

[11] Patent Number: 4,483,125

[45] Date of Patent: Nov. 20, 1984

[54] MACHINE FOR PACKAGING A COMMODITY INTEGRALLY WITH A TRAY

[76] Inventor: Tadoru Suga, 5-5 Shinnakajo-cho, Ibaragi-shi, Osaka-fu, Japan

[21] Appl. No.: 242,992

[22] Filed: Mar. 12, 1981

[30] Foreign Application Priority Data

Mar. 11, 1980 [JP] Japan ..... 55-31303

[51] Int. Cl.[3] ..... B65B 9/10; B65B 51/14; B65B 51/20

[52] U.S. Cl. ..... 53/450; 53/463; 53/550; 53/379

[58] Field of Search ..... 53/547, 550, 373, 379, 53/381 R, 451, 450, 463, 477

[56] References Cited

U.S. PATENT DOCUMENTS

| | | | |
|---|---|---|---|
| 3,552,088 | 7/1968 | Niwa | 53/547 X |
| 3,886,713 | 6/1975 | Mitchell et al. | 53/373 X |
| 3,914,917 | 10/1975 | Young | 53/373 X |
| 3,973,372 | 8/1976 | Omori | 53/441 |
| 4,134,245 | 1/1979 | Stella | 53/547 |
| 4,144,697 | 3/1979 | Suga | 53/547 X |
| 4,183,193 | 1/1980 | Klingelhöfer et al. | 53/550 X |

*Primary Examiner*—Horace M. Culver

*Attorney, Agent, or Firm*—Fisher, Christen & Sabol

[57] ABSTRACT

The packaging machine of the present invention is of the type in which successive trays moving along a conveyor line are enclosed in a continuous tube of plastic film which is thereafter severed between the trays to provide end flaps which are first pulled downwardly by suction forces and then folded upwardly against the bottom of the respective ends of the trays to seal the contents therein. A nozzle system placed near the location where the severing takes place pulls the severed portions of the tube downwardly between each adjacent pair of trays. The nozzle system is controlled by a valve system which teminates the downward pull as the severed portions are being folded upwardly against the bottoms of their respective trays.

32 Claims, 13 Drawing Figures

MACHINE FOR PACKAGING A COMMODITY INTEGRALLY WITH A TRAY

BACKGROUND OF THE INVENTION

The present invention relates to a machine for packaging a commodity as placed in a tray with a plastic film material. More specifically, the invention relates to a packaging machine designed so that trays are arranged at predetermined spaced intervals in a continuous tube formed of a belt-like film of a relatively easily stretchable thermoplastic resin material while such tube is being formed, the tube is cut between each two successive trays, and then the both ends of each cut tube are folded on to the bottom of the tray enclosed therein while being stretched. The invention provides a packaging machine of the tube forming type which permits covering up each tray with a film material in a satisfactorily taut condition.

Known as basic packaging machines of such type are those disclosed by U.S. Pat. Nos. 3,973,372 and 4,144,697. Without exception, these machines are very large in size so that purchase and use of any such machine require considerable cost. From the standpoint of people who manufacture and sell such machines, it is almost impossible to expect the economic burden of the user could be reduced, unless improvements directed toward simplified construction without any decrease in packaging efficiency permits manufacture and sale at economical cost. Without such improvement, favorable commercial operation cannot be expected either.

The prior-art packaging machines as disclosed in the above cited U.S. Patents include means for forming belt-like film into tube forming means, means for feeding trays on to the tube forming means, cutting means for cutting a film tube so formed at points before and behind each tray, vacuum pump means for pulling both ends of each cut tube downwardly, means for folding the cut end of each tube cut on the rear side of the tray on to the bottom of the tray, and means for folding the cut end of each tube cut on the front side of the tray on to the bottom of the tray. One particular disadvantage of the prior-art packaging machines is that the cut tube end on the front side of the tray cannot be folded earlier than the cut tube end on the rear side. The direction the cut tube end is folded on the front side of the tray is opposite to the direction in which the rear side is folded. Therefore if the cut tube end on the front side of the tray is folded at an earlier moment, the folded rear side may come out of contact with the bottom of the tray under the influence of movement of the open-hole rotor means when the tray passes over the rotor means. For this reason, means for folding the cut tube end on the front side of the tray are provided after folding the rear side. Moreover, since the length of the tray to be used varies depending upon the packaging operator's choice, the distance between the first air suction port in the vacuum pump, for pulling downward the cut tube end on the rear side of the tray, and the second air suction port, for pulling downward the cut tube end on the front side of the tray, is required to be set so as to meet the maximum size requirement for trays to be used. This has been a factor responsible for the prior art machines being very large in size. Another disadvantage of conventional machines is that rotary cutting means used therein are relatively complicated in construction, particularly as to bearings for vertically opposed rotors and gear arrangement for synchronous rotation of the rotors.

SUMMARY OF THE INVENTION

The present invention provides an improvement in that the inlet openings of a vacuum pump are disposed in opposed relation on both sides of cutting means so that the cut tube end on the rear side of a preceding tray and the cut tube end on the front side of a succeeding tray are simultaneously pulled toward the ground while cutting is performed, and the individual cut tube ends are simultaneously folded on to the bottoms of the preceding tray and the succeeding tray respectively. Another improvement provided by the invention is that control means are provided to cut off the vacuum on the trailing side of the cutter before the succeeding tray passes beyond the cutter, to ensure that the tube end folded beneath the leading end of the bottom of the succeeding tray will not come off the tray bottom. Still another improvement is adoption of guillotine-type cutting means whereby construction of cutting means is simplified, with an added function to guide cut tube ends downwardly so as to facilitate the operation of pulling the tube ends downward.

DESCRIPTION OF A PREFERRED EMBODIMENT

Figure 1:
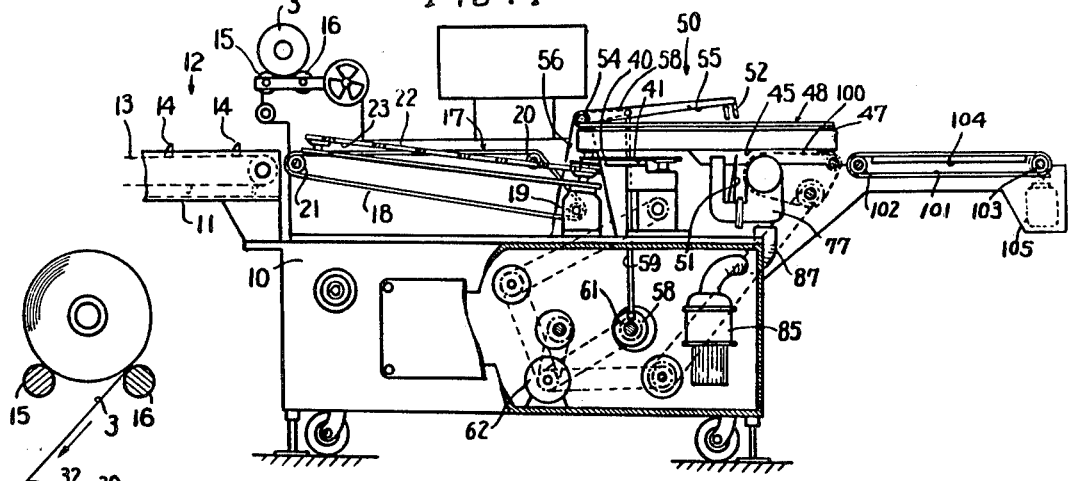
FIG. 1 is a side elevational view showing a preferred form of the machine embodying the present invention.

Referring now to the drawings, there are indicated a commodity at 1, a tray at 2, and a film material at 3.

As FIG. 1, shows, the packaging machine has a box-like stand 10 and various components mounted thereon. At the left end of the stand 10 there is horizontally connected thereto a frame 11 housing a conveyor 12 which feeds trays to a location where film supply is available. In the frame 11, the conveyor 12 actuates endless chains 13 to rotate continuously so as to convey trays in such a manner that attachments 14, provided on chains 13 at certain spaced intervals, push the trays allowing them to slide on the top surface of the frame 11.

On the stand 10 are rotatably supported a pair of rolls 15, 16, on which a roll of film 3 is mounted. A secondary conveyor 17 is provided under the rolls 15, 16 and on the stand 10. Located on the extension of the feed conveyor 12, the conveyor 17 consists of an endless belt 18 supported on the stand 10 through a plurality of pulleys 19, 20, 21.

Tube forming means 22 for rolling a belt-like film sheet 3 are provided along the conveyor 17. Details of the tube forming means 22 are shown in FIGS. 2 to 5, inclusive. As the figures illustrate, the tube forming means 22 consist of a pair of endless chains 23, 23 supported by means of a plurality of chain wheels 26, 27, 28, 26, 27, 28 mounted to a pair of plates 24, 24 which are disposed on both sides of the pair of endless chains 23, 23, and multiplicity of clips 30, 30 provided on the endless chains at equally spaced intervals. The distance between the chains on both sides is substantially equal to the width of film 3 at the film supply end, but it is narrowed midway toward the forward end of the chain track by the pair of chain wheels 28, 28 at said forward end being disposed relatively close to each other. The clips 30, each consisting of a piece 31 and a movable piece 32, are adapted to close under tension of a coil spring 33 and open under pressure of cams 34, 35 fixed to the plate 24, one at each end thereof.

In succession to the tube forming means 22, there is provided a mechanism 40 for drawing the tube which has been formed by rolling the film material 3, around a tray 2 into a more slender and tight tube form. The mechanism 40 consists of an arrangement which rotates a pair of cord-like endless belts 41, 41 in symmetrical directions. These endless belts 41, 41 for a larger part of their respective loops, are fitted in grooves formed on plate-like guides 42 along edges thereof, and they are trained over pulleys 43, 43 and pulleys 44, 44. The pulleys 43, 43 are connected coaxially to rotors 46, 46 disposed thereabove and which support the loops of a pair of flat belts 45, 45 at one end. At the other end, the flat belts 45, 45 are supported by another pair of rotors 47, 47. The rotors 46, 46 at one end and the rotors 47, 47 at the other end are supported in bearing respectively at both ends of a pair of plates 48, 48 supported on the stand 10.

The arrangement thus far described is disclosed and claimed in my prior U.S. Pat. No. 4,144,697, and forms no part of this invention.

Figure 6:
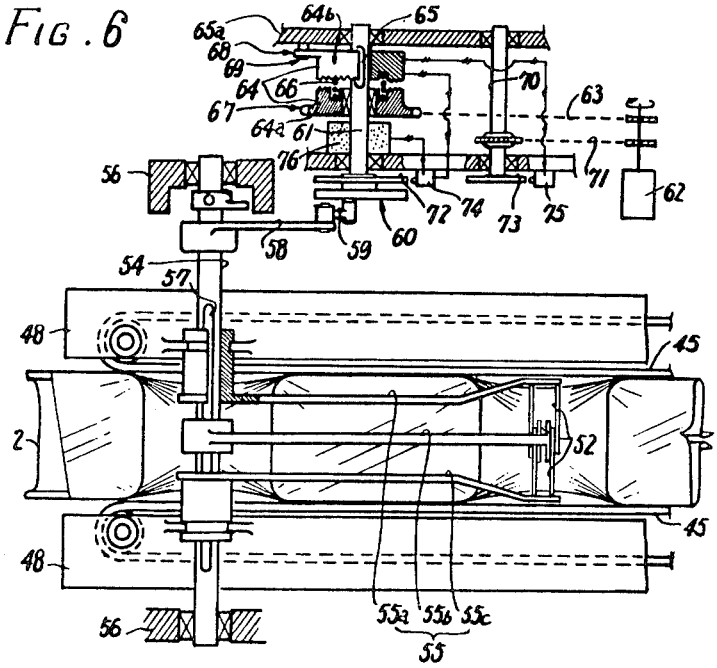
FIG. 6 is a plan view of cutting means.
Figure 9:
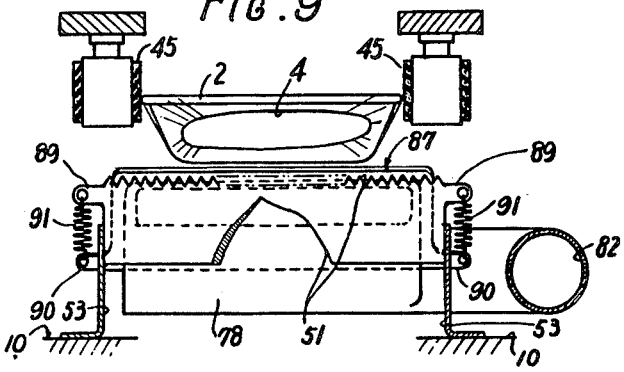
FIG. 9 is a section taken on line IX—IX in FIG. 7.

Next to the mechanism 40 for tautenting the film tube radially, there is provided a cutting means 50 for cutting the tube. The cutting means 50 is of a guillotin-type construction, which fact offers an advantage of facilitating packaging operation. The cutting means 50 consists essentially of an upward facing serrated blade 51 and falling members 52 disposed above the blade 51 and adapted to fall toward it. As FIG. 9 shows, the blade 51 is fixedly supported on the top of the stand 10 at both ends thereof through brackets 53, 53. Moreover, it is arranged so that the ridgeline of the blade is transverse to the axis of the tube 4. The falling members 52 are fixed to arms 55 pivotally movable about a shaft 54 supported on the stand 10 through a bearing 56. As illustrated in FIG. 6 in more detail, the shaft 54 is supported at both ends thereof in bearings 56, 56, while the arms 55 consist of three arms **55*a*, 55*b*, 55*c*, at respective ends of which are disposed three falling members 52. The provision of three falling members 52 is intended to permit selective use thereof for widthwise adjustment according to the width of the tray 2. The two outer arms 55*a*, 55*c* engage the shaft 54 through a slide key mechanism 57, the distance between them being adjustable according to the width of the tray 2 integrally with the flat belts 45, 45 supported on the plates 48, 48. As shown in FIG. 1, a lever 58 fixed to one end of the shaft 54 is connected to a crank mechanism 60 through a crank rod 59, and a main shaft 61 of the crank mechanism 60 is connected to a motor 62 through a chain 63. An arrangement for imparting to the crank mechanism 60 continuous motion from the motor 62 in the form of regular intermittent motion is illustrated in detail in FIG. 6. As shown, the main shaft 61 is provided with an electromagnetic clutch 64, which includes a member 64*a* rotatable relative to the main shaft 61 and provided for operation on one side, and a member 64*b* slidable in the axial direction of the main shaft 61 through a slide key mechanism 65 and provided for operation on another side. A spring 66 is provided between said members 64*a* and 64*b*. Around the rotatably fixed member 64*a* is provided a chain wheel section 67, which is connected to the motor 62 through a chain 63. A piece 68 formed on the peripheral surface of the slidable member 64*b* engages a stopper 69 formed on the bearing 65*a*. An auxiliary shaft 70, disposed in parallel relation to the main shaft 61, is connected to the motor 62 through another chain 71. To the main shaft 61 and the auxiliary shaft 70 are fixed cams 72 and 73 respectively, and there are provided switches 74, 75 adjacent these cams. The switch 74 controls an electromagnetic brake 76 disposed around the main shaft 61, and the slidable member 64*b*. The switch 75 controls the slidable member 64*b***.

Figure 7:
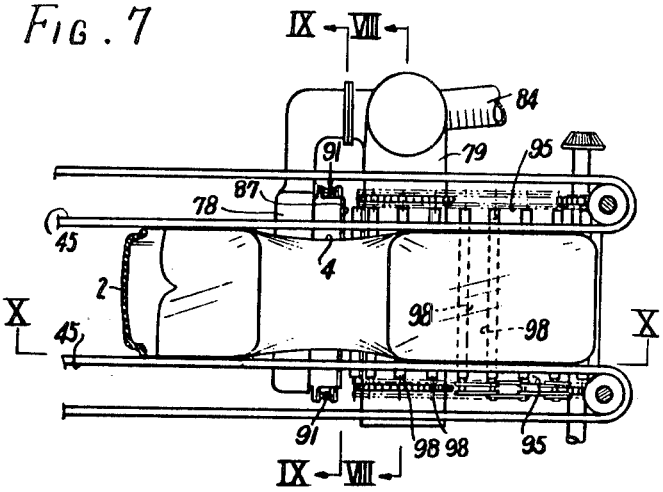
FIG. 7 is a plan view of means pulling toward the ground a tube portion between two successive trays.
Figure 8:
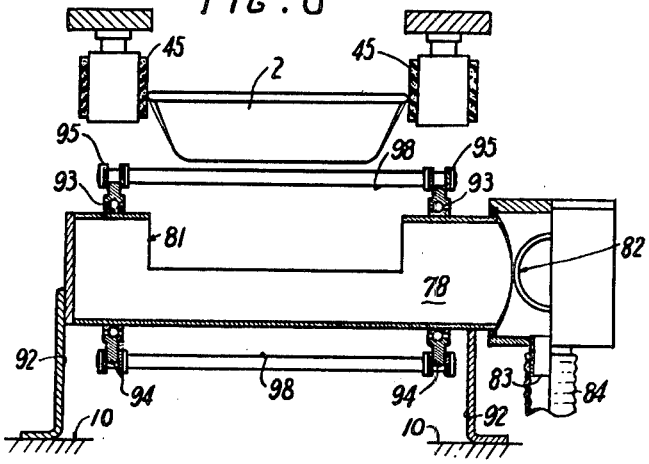
FIG. 8 is a section taken on line VIII—VIII in FIG. 7.
Figure 10:
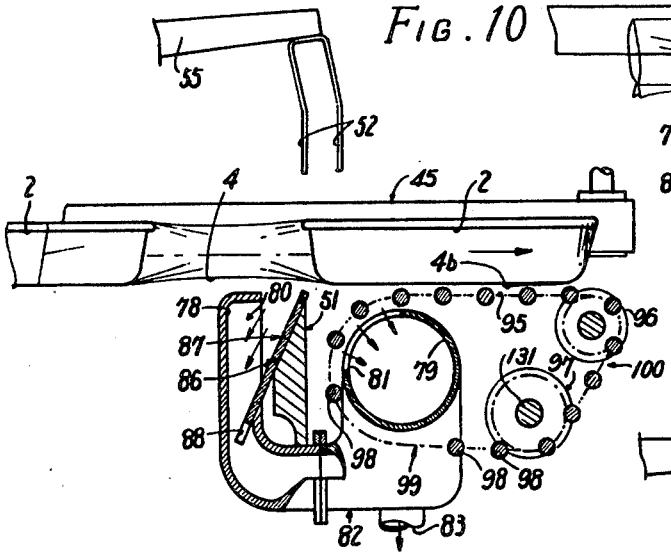
FIG. 10 is a section taken on line X—X in FIG. 7.

As shown in FIG. 1, there are provided folding means 77 for folding cut tube ends on to the bottoms of each of two trays, one on each side of the blade 51 of the cutting means 50. The folding means 77, as more concretely shown in FIGS. 7–12, include an air channel 78 having a square section, disposed alongside the blade 51 on the side opposite to the direction of movememt of trays 2, and an air channel 79 having a circular section, disposed alongside the blade 51 on the side facing the direction of movement of trays 2, both air channels having an axis parallel to the blade 51. The air channels 78, 79 have air suction ports 80, 81 respectively, each disposed in opposed relation to the blade 51, and are connected to each other at one end through a duct 82, which has a port connected to one end of a flexible hose 84, the other end of which is connected to a vacuum pump 85. As shown in FIG. 10 in particular, the blade 51 has a sloped surface 86 on its front side, and a friction plate 87 is provided for sliding engagement, at both lower ends thereof, with gap-like guides 88 formed on both sides of the air channel 78, so that the plate 87 can be held in abutting relation with the sloped surface 86 of the blade 51. As shown in FIG. 9, coil springs 91, 91 are provided between protruding pieces 89, 89 formed at both upper ends of the blade 51 and protruding pieces 90, 90 formed at both ends of the friction plate 87, to subject the friction plate 87 to the force that has the effect of holding the upper end of the plate 87 at a level above the upper end of the blade 51. As FIG. 8 shows, both ends of the air channel 78 is supported on the stand 10 through brackets 92, 92, and between these brackets there are rotatably supported, at locations adjacent both ends of the air channel 78, chain wheels 94, 94 through radial ball bearings 93, 93. Endless chains 95, 95 which are in engagement with the chain wheels 94, 94 are further trained around a plurality of sprockets 97, 97 as shown in FIG. 10. Between said chains 95, 95 there are rotatably supported a multiplicity of round bars 98, 98 as FIG. 7 shows. As can be seen from FIG. 10, the round bars, 98, 98 are closely spaced along most of the lengths of the chains, to form an endless belt, except where a number of the round bars have been left off to provide a large open hole 99 at one location thus forming what may be called a moving shutter means 100; to control the effect of the vacuum in passage 79.

In FIG. 1, there is shown at the right end a heat-resistant endless belt 101 supported by a pair of pulleys 102, 103, said belt 101 being powered by motor 105 for continuous run. A motor 104 is provided inside the loop of the endless belt 101.

Figure 3:
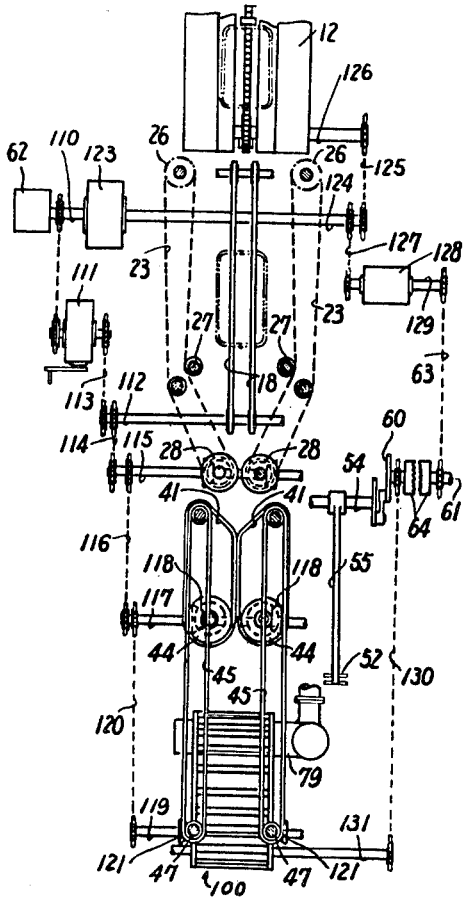
FIG. 3 is a plan view illustrating the process of power transmission.

FIG. 3 illustrates connections between the individual means above described and the motor. Power from the motor 62 is transmitted through two transmission systems, one for film conveying operation and the other for operation relating to movement of trays. An output shaft 110 of the motor 62 transmits power to a variable speed gear 111. The above said power transmission system for film conveying operation transmits output motion of the variable speed gear 111. The speed gear 111 is connected to a shaft 112 through a chain 113 to drive the conveyor 18. The shaft 112 is then connected through a chain 114 to a shaft 115, which in turn is connected to the chain wheels 28 to drive the chains 23, 23. The shaft 115 is connected through a chain 116 to a shaft 117, which in turn is connected to a shaft 119 through a chain 120. The shaft 119 is then connected to pulleys 47, 47 through bevel gears 121, 121. Thus, the conveyor 18, chains 23, 23 belts 41, 41 and flat belts 45, 45 are powered for synchronous rotation.

An output shaft 124 of a reduction gear 123 connected to the motor 62 is connected through a chain 125 to a shaft 126 of the feed conveyor 12. The shaft 124 is also connected through a chain 127 to an over-drive gear 128, an output shaft 129 of which is connected through the chain 63 to the output side of the electromagnetic clutch 64 on the crank shaft 61, a chain connected to the output side of the electromagnetic clutch 64 being trained over a drive shaft 131 of the shutter means 100.

The operation of the preferred embodiment as above described with reference to the drawings will now be explained.

Figure 2:
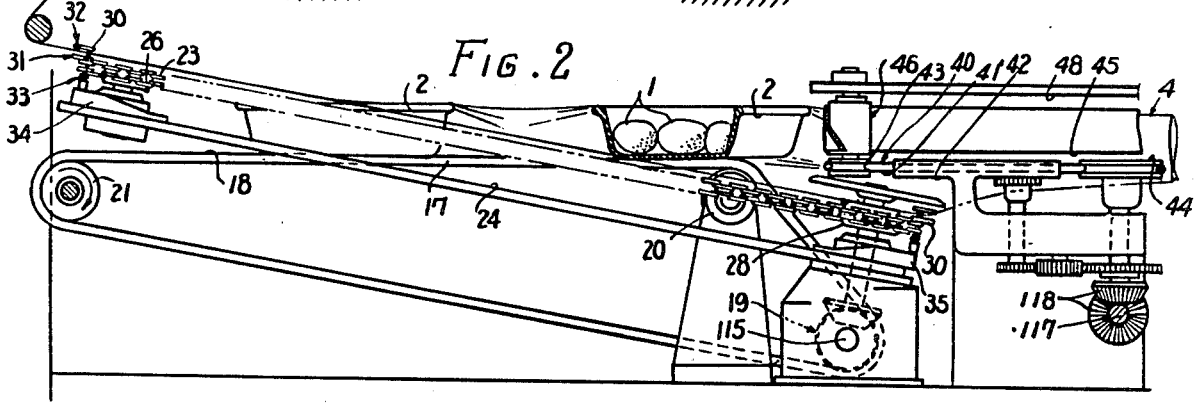
FIG. 2 is an enlarged view of tube forming means in the machine shown in FIG. 1.
Figure 5:
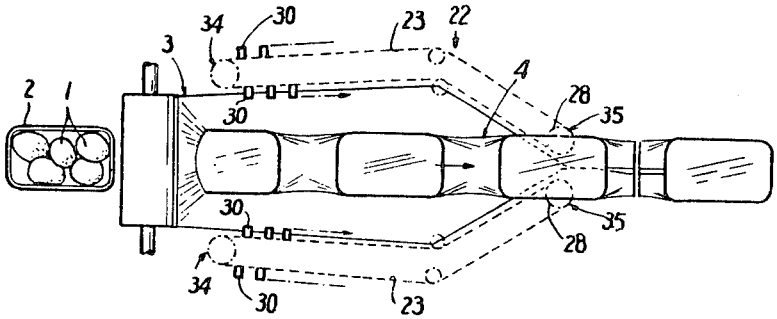
FIG. 5 is a plan view of FIG. 4.

In the tube forming means 22 shown in FIG. 5, a multiplicity of clips 30, 30 disposed on the chains 23 are subjected, at both turning points of each chain 23, to action of cams 34, 35 because of the rotation of each chain 23 in the direction of the arrow. As each clip 30 is acted upon by the cam 34 as shown in FIG. 2, the movable piece 32 is released from the fixed piece 31 against the force of the spring 33. As the film 3 is guided to a point at which clips are temporarily so released, the film 3 is grapsed at both sides thereof by clips 30, 30, one pair after another, with the rotation of the chains 23, 23, being thus conveyed in the direction of the arrow shown in FIG. 5.

Figure 4:
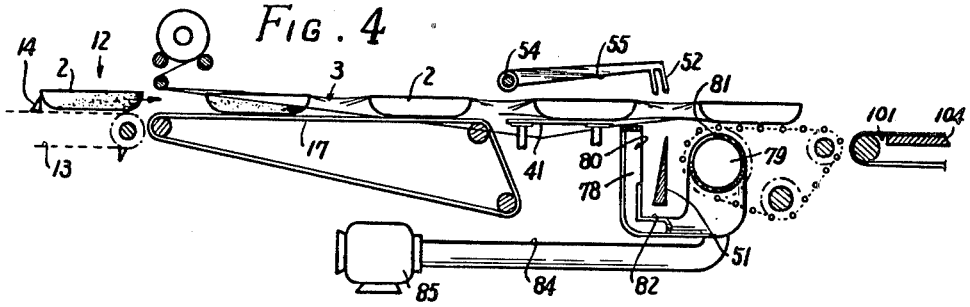
FIG. 4 is a side view illustrating a film tube being formed by tube forming means.

Whilst, as shown in FIG. 4, the conveyor 12 delivers trays 2, 2 . . . at uniform intervals on to the subsequent conveyor 17, which in turn conveys the trays at a level below the film 3. As FIGS. 2 shows, each chain 23 is inclined so that the chain wheel 28 at the forward end of the chain 23 is at a level lower than the upper surface of the belt 18. Moreover, the chain wheels 28, 28 are positioned adjacent to each other. Accordingly, film 3 is automatically formed into a tube 4 around the trays 2. And, both side edges of the film placed on the trays 2 in an A-frame pattern are grasped between rotating cord-like belts 41, 41 at a subsequent conveyor stage, so that the tube 4 formed on the film is reduced in diameter and tautened to go into close contact with each tray 2.

In FIG. 6, the rotation power from the motor 62 is transmitted to chains 63, 71 at constant speed to rotate the chain wheel 67 and auxiliary shaft 70. Since the member **64*a* for said one side is freely rotatable relative to the main shaft 61, no power is transmitted to the main shaft 61 unless the member 64*b* for said other side is axially displaced by electromagnetic action to allow clutch engagement. However, a uniform power is transmitted to the auxiliary shaft 70, and therefore, each one turn of the cam 73 actuates the switch 75 to energize a solenoid coil in the movable member 64*b*. When the solenoid coil is so energized, the movable member 64*b* slides along the key 65 to be disengaged from the stopper 69, and is brought into engagement with the member 64*a* against the spring 66. Thus, rotation power from the motor 62 is transmitted to the main shaft 61 to rotate the crank mechanism 60. The rotation of the crank mechanism 60 is transmitted to the shaft 54 through the rod 59 and lever 58. In FIG. 1, arm 55 of the cutting means 50 turns clockwise to the predetermined angle to cause the members 52 to fall on both sides of the blade 51. Through its continued movement, the crank mechanism 60 actuates the arm 55 to turn counterclockwise to reset; and when the crank pin reaches the top dead center, the crank mechanism 60 actuate the switch 74 through the cam 72 to deenergize the solenoid coil of the movable member 64*b*, while energizing the electromagnetic brake 76. Thus, the main shaft 61 stops rotating, and by reaction force of the spring 66, the movable member 64*b* is caused to reset to its position for engagement with the stopper. And again upon the cam 73 of the auxiliary shaft 70 acting upon the switch 75, the electromagnetic clutch is brought into engagement to actuate the member 52 to fall on both sides of the blade 51. Thus, member 52 is caused to repeat falling relative to the blade 51 by a constant cycle. As shown in FIGS. 10 to 13, inclusive, the falling member 52 presses the film tube 4, between each two of trays 2, 2 . . . arranged at uniformly spaced intervals, against the blade 51 for cutting. As FIG. 3 shows, power from the motor 62 is transmitted to the crank mechanism 60 through the over-drive gear 128, whereby the falling velocity of the falling member 52 is set higher than the travel speed of the tube 4, and therefore, slippage, if any, between the falling member 52 and the tube 4**, when they come into contact, may be substantially reduced.

The vacuum pump 85 shown in FIG. 4 performs continuous air suction, and accordingly, air suction takes place at the inlet ports of two air channels 78, 78 through hose 84. The arrows at air suction ports 80, 81 as shown in FIG. 10 indicate the directions of air flow.

Figure 11:
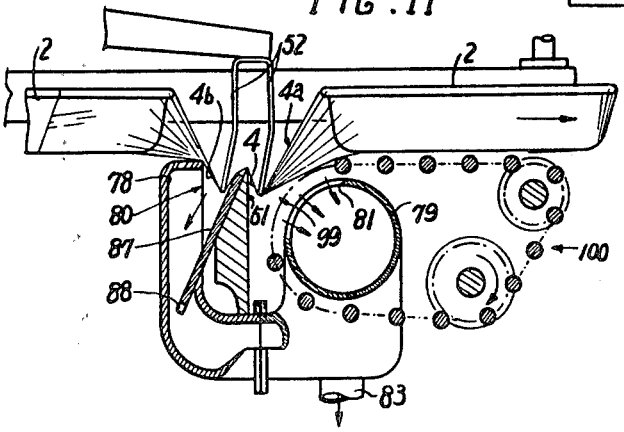

As can be seen from FIGS. 10 and 11, when the falling member 52 falls to press the tube 4 against the blade 51, the friction plate 87 is caused to move downward along the guide 88 by pressure of the tube 4 from above. As shown in FIG. 9, the friction plate 87 is so arranged that its upper end always protrudes above the blade 51 under the pulling force of the springs 91, 91, but by the pressure produced when the falling member 52 presses the tube 4 downward as in FIG. 11, the friction plate 87 is caused to slide downward against the force of the springs 91, 91, to bring the tube 4 into contact with the blade 51. With the downward movement of the friction plate 87, the sectional area of the passage way connecting the air channel 78 shown on the left hand side of the blade and the vacuum pump is decreased, and as a result, suction of air into the air channel on the right hand side of the blade is increased. In other words, the friction plate 87 serves as a valve for adjusting flow rate of air. This valve function of the plate 87 should be remembered because it has a bearing upon the effect of the plate 87 as will be explained later.

Figure 13:
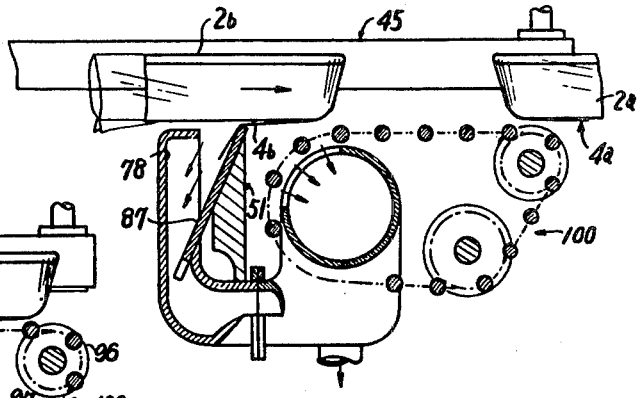
FIGS. 11 to 13, inclusive, are illustrations intended to explain the operation of the means shown in FIG. 10.
Figure 12:
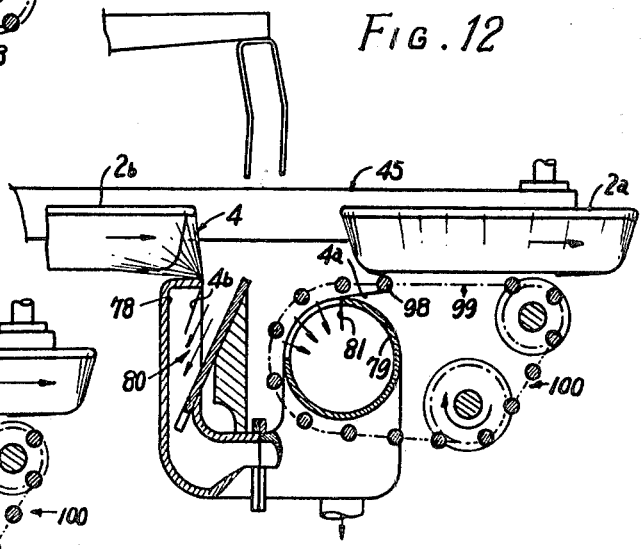

As shown in FIG. 3, the falling member 52 and open-hole rotor 100 are connected to each other through a chain 130, and accordingly these two elements perform synchronous movement. That is, while the falling member 52 stays at its position shown in FIG. 10, the moving shutter means 100 is at a rest with its open hole 99 facing downward, and while the falling member 52 is performing a cycle of downward and upward movement, the shutter means 100 makes one turn and then stops. More concretely, assuming that a tray 2 passes above the blade 51 in a second, the falling member 52 and shutter means 100 operate intermittently in such a way that they stop $\frac{2}{3}$ sec. and work $\frac{1}{3}$ sec. The falling member 52 and shutter means 100 begin to move from the condition as shown in FIG. 10; and substantially synchronously with the falling member 52 pressing the tube 4 against the blade 51 as in FIG. 11, the open-hole 99 of the shutter means 100 is positioned in opposed relation to the air suction port 81 of the air channel 79. And as shown in FIG. 12, the tube 4 is cut between a preceding tray 2*a* and a succeeding tray 2*b*; and the tube end 4*a* of the tube 4 cut on the rear side of the preceding tray 2*a* is pulled into the air suction port 81 of the air channel 79 on one side, and the tube end 4*b* of the tube 4 cut on the front side of a succeeding tray 2*b* into the air suction port 80 of the air channel 78 on the other side. The moving shutter means 100 runs at a higher speed than tray 2*a*, and after the tube end 4*a* is caught on the forefront round bar 98 of the open-hole portion 99, thereby being folded on to the bottom of the tray 2, the shutter means and bars 98 are caused to stop in such condition as shown in FIG. 13. A succeeding tray 2*b* follows the preceding tray 2*a* through conveying action of the flat belts 45, 45 on both sides, and the tube end 4*b* cut on the front side of the tray 2*b* is folded on to the bottom of the tray 2*b* as it is pulled by the other air channel 78. Meanwhile, the upper end of the friction plate 87 is allowed to protrude above the upper end of the blade 51 by spring force, with the result that the sectional area of the passageway connecting the air channel 78 to the vacuum pump is increased. Accordingly, the tube end 4*b* is pulled strongly toward the ground. And the tube end 4*b* is caused to slide along the friction plate in contact therewith. Thus, the tube end 4*b* is naturally stretched out. Subsequently, the succeeding tray 2*b* in FIG. 13 takes the same position as the preceding tray 2 in FIG. 10. At this time, the shutter means 100 are at rest. Therefore, the tube end 4*b* folded beneath the front portion of the tray does not come off.

As can be clearly understood from FIG. 12, the tube end 4*a* cut on the rear side of the tray is folded by the moving shutter means 100 rotating at a speed three times as high as that of the flat belts 45, whereas the tube end 4*b* cut on the front side of the tray is folded at a speed corresponding to the rotation rate of the flat belts 45. Therefore, instantly the tube 4 is cut by means of the falling member 52 and the blade 51 as shown in FIG. 11, the air channel 79 on the right hand side of the blade 51 is required to suck the tube end 4*a* into the air suction port 81 sooner than the tube end 4*b*. The sucking capacity of the air channel 79 can be increased by employing a larger-capacity vacuum pump. However, from an economical stand point, it is impracticable to use one having an unreasonably large capacity. In the invention, therefore, the friction plate 87 is downwardly displaceable for adjustment of air flow rate in the air channel 78, whereby the flow rate in the air channel 78, whereby the flow rate in the air channel 79 can be temporarily increased. With such arrangement, it is possible to prevent errors in the folding of tube ends on to the bottom of a tray, without necessity of employing a larger-capacity vacuum pump. Moreover, as FIG. 11 shows, when the falling member 52 presses the tube 4 against the blade 51 for cutting, the tube ends 4*a*, 4*b* are forcibly guided toward the ground by the falling member 52 on both sides of the blade 51. In other words, the tube ends 4*a*, 4*b* are brought by the falling member 54 to locations adjacent to air suction ports 80, 81, and this improves the efficiency of tube end pulling operation by the air channels 78, 79.

In FIG. 3, by control of the variable speed gear 111, it is possible to vary the velocity of movement of trays 2 and tubes 4 enclosing the trays, independently of the run speeds of the falling member 52 and shutter means 100. Accordingly, it is possible to have the falling member 52 drop always centrally of each pair of trays by increasing conveyance speed of trays and tubes if trays of larger length are employed, or by decreasing conveyance speed if trays of smaller length are used.

In the packaging machine according to the present invention, the shutter means 100 are intermittently moved at high speeds so that the rotor means 100 are at rest when trays 2 pass thereabove. Therefore, the tube end 4*b* cut on the front side of the tray 2 and folded beneath the tray will not come off. Thus, it is possible to provide air channel 78 in front of the blade 51 on the side facing the direction of movement of the tray, in addition to the one on the opposite side. The provision of air channels 78, 79 on both sides of the blade 51 makes it possible that the tube end 4*a* cut on the rear side of a preceding tray and the tube end 4*b* cut on the front side of a succeeding tray are pulled toward the ground, on both sides of the blade 51, and folded on to the bottoms of the respective trays. Such a way of folding provides the same results as obtained in the case where tube ends on the front and rear sides of one tray are simultaneously folded. There may occur a question as to whether same results may be obtained if both tube ends are simultaneously folded on both sides of the shutter means 100. However, it must be pointed out that since the tray 2 is subject to variation in length according to the use requirements, the distance between the two air channels should be determined so as to suit the largest possible tray length. In this connection, it is noted that the distance between a preceding tray and a succeeding tray may be constant if there is any change in tray length. Where air channels 78, 79 are provided on both sides of the blade 51, as in the present invention, the distance between the air channels may be smaller. Therefore, according to the present invention, it is possible to manufacture a packaging machine which is more compact and smaller in size. Yet, conveyor means 45, 45 for conveying trays 2 are for continuous and constant rotation. Intermittent operation of moving shutter means 100 in no way effects the capacity of the machine. Moreover, the falling member 52, during cutting operation, forcibly guides cut tube ends 4 to location near air suction ports 80, 81 of two air channels 78, 79. This means improved efficiency of the step of pulling the tube ends toward ground. Such a function facilitates the miniaturization of the vacuum pump. In addition, the friction plate 87, which imparts friction resistance to the tube ends and aids in tautening the tube, serves as a valve for air flow adjustment and temporarily increases air suction into the air channel 79 to cope with the action of the shutter means 100. This permits miniaturization of the vacuum pump. Furthermore, the adoption of a guillotine type cutting means 50 means more simple construction of bearing portions as compared with conventional rotary cutting means. It also provides more space in transport zone and easier access for artificial operation.

What is claimed is

1. A method of packaging articles in continuously moving trays comprising:

(a) enclosing said trays in a tube of film while continuously moving said trays;

(b) causing a falling member to fall upon said tube of film between adjacent trays pressing said tube of film upon a slidable friction plate;

(c) exerting downwardly suction forces adjacent each side of said friction plate;

(d) causing said slidable friction plate to slide downwardly by the force of the falling member, exposing a knife means;

(e) severing said tube of film with said knife means providing a trailing end flap on the preceding tray and a leading end flap on the succeeding tray;

(f) decreasing said downwardly suction force on one side of said friction plate while simultaneously increasing said downwardly suction force on the other side of said friction plate; and (g) folding the end flaps upwardly against the respective trays.

2. The method of claim 1, wherein said falling member includes two bars which straddle said knife means and force said tube of film on said friction plate.

3. The method of claim 1, wherein said friction plate is normally spring biased above the severing edge of said knife means.

4. The method of claim 1, wherein folding the end flaps includes an endless chain for folding said trailing end flap.

5. The method of claim 4, wherein said endless chain includes a moving shutter means comprising a sufficiently large open area in said endless chain to expose said downwardly suction force to said trailing end flap.

6. The method of claim 5, wherein said moving shutter means and said falling member are interconnected for synchronous movement, wherein said falling member is normally positioned above said friction plate whenever said moving means is facing downwardly, and whenever said falling member is pressing said tube of film against said friction plate, said moving shutter is exposing said downwardly suction forces to said trailing end flap.

7. An apparatus for packaging articles in trays of the type wherein trays moving continuously in an elongated path are successively enclosed within a length of continuously moving thermoplastic film to provide a succession of regularly spaced trays contained within an elongated tube of said film which is thereafter to be transversely severed between successive trays to form separate lengths of said tube each containing a tray and provided with end flaps of the respective leading and trailing ends of a tray to be folded respectively backwardly and forwardly to seal trays within separate lengths of film, the improvement comprising: knife means for transversely severing said tube of film between an adjacent pair of said moving trays to provide a trailing end flap for the preceding tray and a leading end flap for the succeeding tray;

suction port means mounted below said elongated path of movement of the trays and adjacent said knife means to be connected to a source of vacuum for simultaneously exerting downward suction forces on said end flaps;

folding means for folding said end flaps upwardly against a respective one of the adjacent trays after said downward suction forces have been exerted;

control means for the port means to exert said suction forces after the knife means has severed the tube and to reduce said suction forces on said leading end flap; and said suction port means comprises dual ports, one port positioned adjacent each side of said knife means.

8. The apparatus of claim 7, wherein said knife means is a stationary blade positioned below said tube of film enclosing the trays.

9. The apparatus of claim 8, wherein a falling member, including two bars, is associated with said knife means to help sever said tube of film by causing the falling member to fall upon said tube of film, wherein said two bars straddle said knife means and force said tube of film down upon the knife means to sever said tube of film.

10. The apparatus of claim 7, wherein said dual ports are interconnected to a common duct which is fluidly connected to a source of vacuum.

11. An apparatus for packaging articles in trays of the type wherein trays moving continuously in an elongated path are successively enclosed within a length of continuously moving thermoplastic film to provide a succession of regularly spaced trays contained within an elongated tube of said film which is thereafter to be transversely severed between successive trays to form separate lengths of said tube each containing a tray and provided with end flaps of the respective leading and trailing ends of a tray to be folded respectively backwardly and forwardly to seal trays within separate lengths of film, the improvement comprising: knife means for transversely severing said tube of film between an adjacent pair of said moving trays to provide a trailing end flap for the preceding tray and a leading end flap for the succeeding tray;

suction port means mounted below said elongated path of movement of the trays and adjacent said knife means to be connected to a source of vacuum for simultaneously exerting downward suction forces on said end flaps;

folding means for folding said end flaps upwardly against a respective one of the adjacent trays after said downward suction forces have been exerted;

control means for the port means to exert said suction forces after the knife means has severed the tube and to reduce said suction forces on said leading end flap; and said control means comprising a friction plate slidably interconnected with said knife means.

12. The apparatus of claim 11, wherein said friction plate is spring biased above the severing edge of the knife means.

13. The apparatus of claim 12, wherein a falling member normally positioned above said knife means is caused to fall and press said tube of film against said spring biased friction plate which slides downwardly, exposing said knife means which severs said tube of film.

14. The apparatus of claim 11, wherein said friction plate acts as a valve to decrease said suction force on said leading end flap and increase suction force on said trailing end flap.

15. An apparatus for packaging articles in trays of the type wherein trays moving continuously in an elongated path are successively enclosed within a length of continuously moving thermoplastic film to provide a succession of regularly spaced trays contained within an elongated tube of said film which is thereafter to be transversely severed between successive trays to form separate lengths of said tube each containing a tray and provided with end flaps of the respective leading and trailing ends of a tray to be folded respectively backwardly and forwardly to seal trays within separate lengths of film, the improvement comprising: knife means for transversely severing said tube of film between an adjacent pair of said moving trays to provide a trailing end flap for the preceding tray and a leading end flap for the succeeding tray;

suction port means mounted below said elongated path of movement of the trays and adjacent said knife means to be connected to a source of vacuum for simultaneously exerting downward suction forces on said end flaps;

folding means for folding said end flaps upwardly against a respective one of the adjacent trays after said downward suction forces have been exerted;

control means for the port means to exert said suction forces after the knife means has severed the tube and to reduce said suction forces on said leading end flap; and said folding means including an endless chain for folding said trailing end flap.

16. The apparatus of claim 15, wherein said control means comprises a spring biased friction plate interconnected with and extending above said knife means, wherein said friction plate also serves as an element of said folding means for folding the leading end flap whenever said friction plate is biased above said knife means.

17. The apparatus of claim 15, wherein said endless chain includes a moving shutter means comprising a large open area in said endless chain slightly bigger than said suction port means whereby said moving shutter means rotates with said endless chain.

18. The apparatus of claim 17, wherein a falling member normally positioned above said knife means is caused to fall and press said tube of film against said knife means which severs said tube of film.

19. The apparatus of claim 18, wherein said moving shutter means and said falling member are interconnected for synchronous movement wherein said falling member is normally postioned above said knife means whenever said moving shutter means is facing downwardly, and whenever said falling member is pressing said tube of film, said moving shutter means is immediately above said suction port.

20. An apparatus for packaging articles in continuously moving trays by enclosing said trays in a tube of film, the improvement comprising:

(a) knife means for transversly severing said tube of film between adjacent moving trays to provide a trailing end flap for the preceeding tray and a leading end flap for the succeeding tray;

(b) dual suction port means mounted below said moving trays adjacent to said knife means to be connected to a source of vacuum, wherein one suction port is mounted on each side of said knife means for simultaneously exerting downward suction forces on said end flaps;

(c) folding means for folding said end flaps upwardly against the respective trays after said downwardly suction forces have been exerted; and (d) control means for said dual suction port means for reducing said suction forces on said leading end flap.

21. The apparatus of claim 20, wherein said knife means is a stationary blade positioned below said tube of film enclosing the trays.

22. The apparatus of claim 21, wherein a falling member, including two bars, is associated with said knife means to help sever said tube of film by causing the falling member to fall upon said tube of film, wherein said two bars straddle said knife means and force said tube of film down upon the knife means to sever said tube of film.

23. The apparatus of claim 20, wherein said dual suction port means are interconnected to a common duct which is fluidly connected to a source of vacuum.

24. The apparatus of claim 20, wherein said control means comprises a friction plate slidably interconnected with said knife means.

25. The apparatus of claim 24, wherein said friction plate is spring biased above the severing edge of the knife means.

26. The apparatus of claim 25, wherein a falling member, normally positioned above said knife means, is caused to fall and press said tube of film against said spring biased friction plate which slides downwardly, exposing said knife means which sever said tube of film.

27. The apparatus of claim 24, wherein said friction plate acts as a valve to decrease said suction force on said leading end flap and increase said suction force in said trailing end flap.

28. The apparatus of claim 20, wherein said folding means includes an endless chain for folding said trailing end flap.

29. The apparatus of claim 28, wherein said control means comprises a spring biased friction plate interconnected with and extending above said knife means, wherein said friction plate also serves as an element of said folding means for folding the leading end flap whenever said friction plate is biased above said knife means.

30. The apparatus of claim 28, wherein said endless chain includes a moving shutter means comprising a large open area in said endless chain slightly bigger than said suction port means whereby said moving shutter means rotates with said endless chain.

31. The apparatus of claim 30, wherein a falling member, normally positioned above said knife means, is caused to fall and press said tube of film against said knife means which severs said tube of film.

32. The apparatus of claim 31, wherein said moving shutter means and said falling member are interconnected for synchronous movement wherein said falling member is normally positioned above said knife means, whenever said moving shutter means is facing downward, and whenever the falling member is pressing against said tube of film, said moving shutter means is immediately above said suction port.

* * * * *